US010195118B2

(12) United States Patent
Eerden

(10) Patent No.: US 10,195,118 B2
(45) Date of Patent: Feb. 5, 2019

(54) PACIFIER

(71) Applicant: KONINKLIJKE PHILIPS N.V., Eindhoven (NL)

(72) Inventor: Jacco Christof Eerden, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/038,488

(22) PCT Filed: Dec. 4, 2014

(86) PCT No.: PCT/EP2014/076472

§ 371 (c)(1),
(2) Date: May 23, 2016

(87) PCT Pub. No.: WO2015/086411

PCT Pub. Date: Jun. 18, 2015

(65) Prior Publication Data

US 2016/0296424 A1 Oct. 13, 2016

(30) Foreign Application Priority Data

Dec. 9, 2013 (EP) ..... 13196236

(51) Int. Cl.
*A61J 17/00* (2006.01)

(52) U.S. Cl.
CPC ..... *A61J 17/008* (2015.05); *A61J 17/001* (2015.05)

(58) Field of Classification Search
CPC ..... A61J 17/00; A61J 17/008
See application file for complete search history.

(56) References Cited

U.S. PATENT DOCUMENTS

| | | | | |
|---|---|---|---|---|
| 3,363,630 | A * | 1/1968 | Hines | A61J 17/008 606/234 |
| 4,819,641 | A * | 4/1989 | Russell | A61J 17/008 215/11.3 |
| 5,578,058 | A * | 11/1996 | Chen | A61J 17/008 606/234 |
| 6,461,374 | B2 * | 10/2002 | Huang | A61J 17/008 606/236 |
| 7,311,721 | B2 * | 12/2007 | Rosuck | A61J 17/008 215/11.1 |
| 2005/0261739 | A1 * | 11/2005 | Chen | A61J 17/008 606/234 |
| 2006/0135997 | A1 * | 6/2006 | Carmona | A61J 17/008 606/234 |
| 2010/0152774 | A1 * | 6/2010 | Branham | A61J 17/008 606/236 |

(Continued)

FOREIGN PATENT DOCUMENTS

| | | |
|---|---|---|
| CN | 2291153 Y | 9/1998 |
| CN | 101977581 A | 2/2011 |

(Continued)

*Primary Examiner* — Julie A Szpira

(57) ABSTRACT

A pacifier (1) is provided which comprises a nipple (2) and a shield (3) made of an elastic material. The shield (3) comprises two stable mechanical states: one in which the shield (3) acts as a shield and another in which the shield (3) acts as a nipple cover. The shield (3) is transformable from one stable mechanical state to another upon an impact to the shield (3).

6 Claims, 1 Drawing Sheet

(56) References Cited

U.S. PATENT DOCUMENTS

| | | | | |
|---|---|---|---|---|
| 2011/0288585 | A1* | 11/2011 | Boughalem ..... | A61J 17/008<br>606/234 |
| 2013/0331887 | A1* | 12/2013 | Subramanian ..... | A61J 17/008<br>606/236 |
| 2014/0257387 | A1* | 9/2014 | Saxton ..... | A61J 17/001<br>606/236 |

FOREIGN PATENT DOCUMENTS

| | | | |
|---|---|---|---|
| CN | 202029611 | U | 11/2011 |
| DE | 19858003 | A1 | 5/1999 |
| DE | 20014123 | U1 | 1/2001 |
| FR | 2980690 | A1 | 4/2013 |

* cited by examiner

PACIFIER

FIELD OF THE INVENTION

The present invention relates to a pacifier, comprising a nipple and a shield.

BACKGROUND OF THE INVENTION

Many infants have a suckling instinct during the first years of their lives. This instinct ensures that the infant receives his required nutrition. However, infants often have a suckling urge when they are not hungry such as when they are upset or tired. Pacifiers are used to satisfy an infant's non-nutritional suckling instinct in order to comfort them.

Unfortunately, children regularly drop or throw their pacifiers on the ground. This will cause the pacifier be covered with dirt and bacteria. This is very frustrating for the parent as it is almost impossible to wash a pacifier every time it is dropped or touches something dirty.

A known solution is the Razbaby Keep-it-clean pacifier. This pacifier has, besides the common nipple and the shield, a built-in nipple cover which cons consists of two spherical shaped cover parts. The two cover parts are connected to each via a joint. When a child sucks on the nipple, the cover parts are hold in an open position by a spring release. When the pacifier falls out of the child's mouth and the shield or the cover parts hit the ground, the spring release is triggered and the cover parts connect to each other, thereby surrounding the nipple.

A disadvantage of this pacifier is that it contains many parts. The present invention addresses the existing problem.

SUMMARY OF THE INVENTION

It is an object of the invention to provide an improved cover for a pacifier.

According to the invention this object is realized in that a pacifier comprises a nipple and a shield made of an elastic material, wherein the shield has two stable mechanical states, a first state serving the purpose of a shield and a second state serving the purpose of a nipple cover, wherein the shield is arranged such that, upon impact to the shield, tension built up in the elastic material of shield transfers the shield from the first state to the second state.

The shield of the pacifier is shaped such that it is possible to obtain two stable mechanical states with only one element. In the first state the shield is folded away from the nipple and in an open position. When the shield is in the first state, it acts as a shield present on the pacifier to prevent that the nipple is being swallowed by a child in its mouth. In the second state the shield is folded in the direction of the nipple and surrounding the nipple at least partly. In the second state the shield is in a closed position. If the shield is in the second state, the shield acts as a nipple cover to protect the nipple from contact with other objects. In this way the pacifier does not need to comprise both a shield and an additional attached nipple cover: the shield can function as a shield and as a nipple cover. Thus, the number of pacifier parts is reduced.

The pacifier shield transfers from the first stable mechanical state to the second stable mechanical state upon impact. An impact is an instantaneous force, which is different from a continuous force. The shield is shaped such that it transfers from the first, unfolded state to the second, folded state upon impact. The shield will bend from the first state in the direction of the nipple and surrounds the nipple at least partly, if the unfolded shield is affected by an impact. An impact could for example be the hitting of the floor, when the pacifier has fallen out of the child's mouth: when a part of the unfolded shield hits the floor, the shield is being deformed locally and the deformed shield part transfers its deformation stress to an adjacent shield part. The impact thus triggers the shield to transfer from the first stable mechanical state to the second stable mechanical state.

The shield can be folded in the direction of the nipple as well, closing the shield. The nipple can for example be stored in a bag with other objects without the need to protect the nipple and pacifier with an additional, separate pacifier cover. In this way the nipple does not become dirty or infected with bacteria or else, because the folded shield surrounds the nipple at least partly and thus prevents the nipple from contacting contaminated objects, such as a napkin or a towel. When the shield is folded in the direction of the nipple, the pacifier can easily be stored. When for example a caretaker wants to feed a baby, he bends the shield into the direction of the nipple. Thus, the shield folds around the nipple to safely and hygienically put the pacifier aside. There is no need to put the pacifier in a casing or to put it out of reach other children, who want to play with the pacifier or put it in their mouth, and there is no risk of, when falling on the ground, while unprotected, the nipple becoming dirty. In this way the caretaker does not have to clean the nipple before reinserting the nipple into the child's mouth. The shield of the pacifier thus serves two purposes: in the first state being a shield to prevent the nipple from being swallowed into the child's mouth and in the second state being a cover to easily and hygienically protect the nipple.

Advantageously the shield has a curved geometry. The curved geometry forms part of a sphere. The curved geometry therefore has two stable mechanical states. In the first state the shield is curved such that it bends away from the child's mouth. This shape does not hinder a child from suckling on the nipple and it does not leave red marks on the child's cheeks. In the second state the shield is curved such that it surrounds the nipple. The shape of the pacifier is then spherical and protects the nipple well, such that the pacifier can be easily and hygienically stored.

In a preferred embodiment the shield is spherically shaped in both the first stable mechanical state and the second stable mechanical state. In the first state, the shield is unfolded and bended in a direction away from the nipple and serving the purpose of a shield. The curvature of the bended shield is spherical. In the second stable mechanical state the shield is folded in the direction of the nipple. When spherically shaped, the shield surrounds the nipple and direct contact of the nipple with objects in the environment is not possible. When the shield is in the second stated and folded around the nipple, the pacifier can be put in a bag or on the table without running the risk that the nipple becomes infected by objects contaminated with bacteria. Furthermore, when fallen on the ground, contact between the nipple and sand, water, hair or other dirt which is unhygienic is prevented. As a result, prior to reinserting the pacifier in the child's mouth, the caretaker does not have to clean the pacifier.

Preferably the geometry of the shield is such that tension is built up in the material of the shield such that it transfers from the first state to the second state upon an impact to the shield. A force exceeding a threshold force, e.g. an impact, executed on the shield triggers the shield to transfer from the first mechanical state to the second mechanical state or vice versa. The force executed on the shield to have the shield transferred can be applied by a caretaker to protect the nipple against the environment or to uncover the nipple for reinserting in a child's mouth. The force can also be applied on the shield by an impact. Upon impact the shield transfers from the first stable mechanical state to the second stable mechanical state. So if the shield hits an object, for example the floor, the shield transfers from the open position to the closed position and will cover the nipple.

In a preferred embodiment the shield comprises one or more cutouts. When the shield parts between the cutouts are brought in close proximity to each other a housing forming a cavity for the nipple is formed, which can partially or substantially surround the nipple. The one or more cutouts allow the shield to transfer more easily from the first state to the second state and vice versa. Advantageously the cutouts are primarily oriented in a direction away from the nipple. Consequently in a second state the cutouts are oriented from the lower side of the nipple to the upper side of the nipple. The presence of a cutout reduces the tangential stress in the shield. Consequently to transfer the shield from the first state to the second state or vice versa requires a lower force.

Advantageously the cutouts in the shield are shaped such that they allow unhindered breathing of a child. When the shield is in the first stable mechanical state, i.e. is folded away from the nipple, the shield functions as a shield. For safety reasons the shield has to be large enough to prevent the pacifier from being swallowed, when the child sucks on the nipple. Furthermore the shield has to be shaped such that it allows a child to breathe through its nose while having a pacifier his mouth. If not, the child would continuously have to open his mouth to breathe and run the risk of losing the pacifier. These conditions can be met when the cutouts are shaped such that they do not cover the nose of the child and the child can breathe unhindered.

The pacifier according to the invention contributes to weight reduction of the pacifier. Because the shield performs the two functions of shield and nipple cover, the weight of the pacifier is lower than when a shield and an additional built-in nipple cover are present in the pacifier.

The pacifier also contributes to the reduction of objects to look after. Children do not always use a pacifier or caretakers do not want children to suckle on a pacifier all time. Hence, a separate case is needed to keep the pacifier clean regardless of where the pacifier is being stored, such as in a purse, diaper bag, or at home. Some pacifiers have cases or lids that fit over the nipple. However, cases and lids get lost or broken, making them less convenient than intended. Additionally, cases are too bulky to be carried in a pocket. With the pacifier according to the invention there is no need for an additional pacifier cover to hygienically and safely store the pacifier.

BRIEF DESCRIPTION OF THE DRAWINGS

These and other aspects of the pacifier of the invention will be further elucidated and described with reference to the drawings in which.

DETAILED DESCRIPTION OF THE EMBODIMENTS

Figure 1:
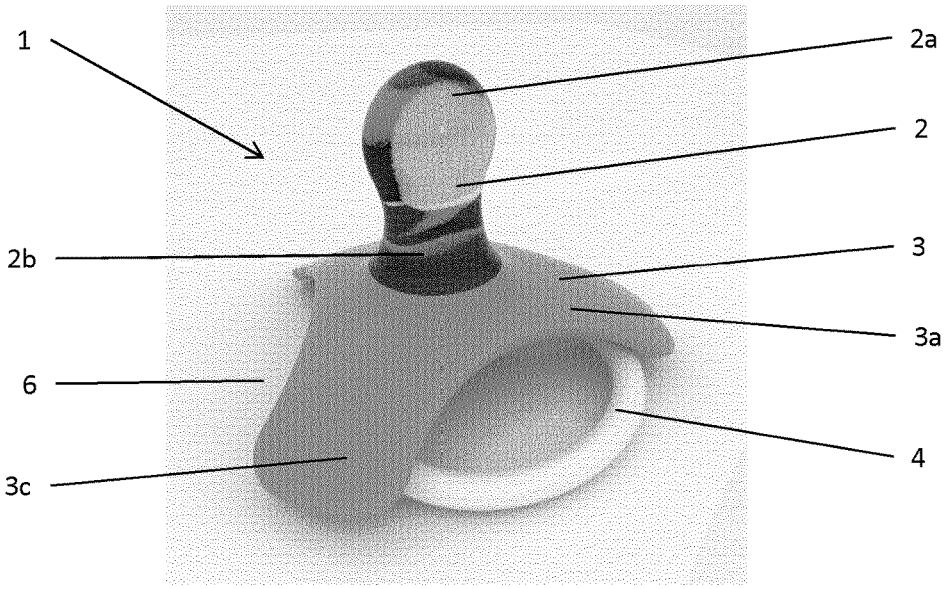
FIG. 1 illustrates a pacifier in a first state.
Figure 2:
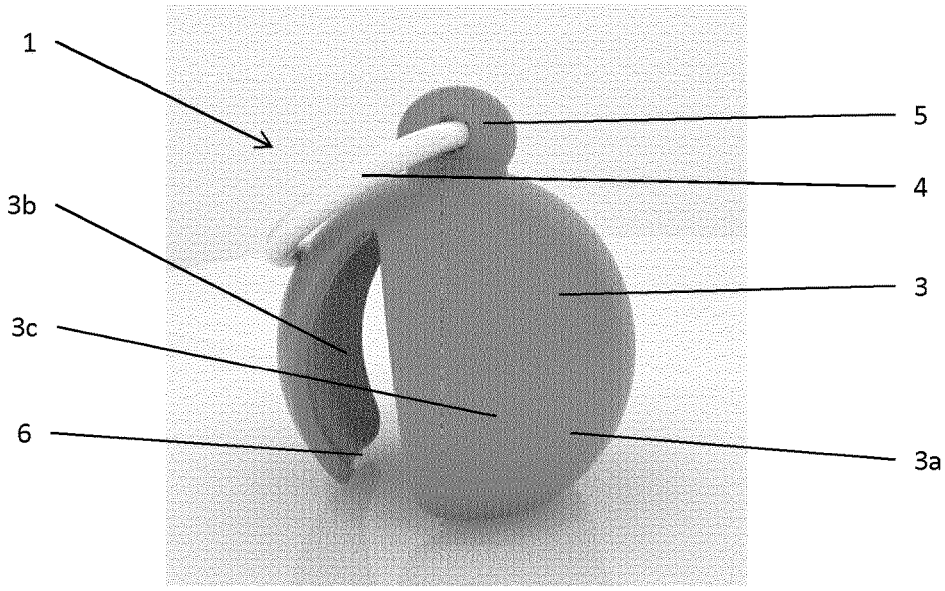
FIG. 2 illustrates a pacifier in a second state.

FIG. 1 presents a pacifier 1 in a first stable mechanical state, while FIG. 2 presents a pacifier 1 in a second stable mechanical state. Referring now to FIGS. 1 and 2, this example provides a pacifier 1 according to an embodiment of the invention. The pacifier 1 includes a nipple 2 and a shield 3. The shield 3 is on the upper side connected to the nipple 2. The pacifier 1 may further include a handle 4 connected to the lower side of the shield 3. The handle 4 may be connected to the shield 3 directly or via a knob 5.

The pacifier 1, including the nipple 2, shield 3, handle 4 and knob 5, may be constructed of any material suitable for the purpose, such as suitable plastics or elastomers or the like with similar pliability.

The nipple 2 is conventionally made of an elastomeric material. The nipple 2 could be made of silicone, or preferably liquid silicone rubber, or latex or another elastic material. The nipple 2 can be hollow or solid and can be of any preferred shape. The size of the nipple 2 is variable and is generally dependent on the child's mouth. The nipple 2 size grows progressively made in the larger sizes as the child's mouth grows.

The shield 3 is a substantially flexible shield 3 including an upper side 3*a* and a lower side 3*b*. The upper side faces the nipple 2 and the lower side faces the handle 4. The upper side 3*a* of the shield 3 is closer to and connected to the nipple 2, while the lower side 3*b* is closer to the handle 4. The handle 4 can be directly connected to the shield 3 or via the knob 5. The nipple 2 is generally attached at the center of the upper side 3*a* of the shield 3. The symmetric position of the nipple 2 provides a comfortable placement in the child's mouth: the pacifier 1 does not have a tendency to shift or turn due to gravity moment.

The shield 3 of the pacifier 1 is shaped such that it can obtain two stable mechanical states with only one element. FIG. 1 illustrates a shield in the first stable mechanical state folded away from the nipple 2. The nipple 2 is then easily accessible for a child's mouth to suckle on the pacifier 1. The shield 3 is then in an open position: the nipple 2 is accessible for a child to suckle on. This first state is a stable mechanical state: when no force is applied to the shield 3, the shield 3 remains in the first state. In the first state the shape of the shield 3 is convex. In the first state the radius of the curvature of the surface of the upper side 3*a* of the shield 3 is larger than the radius of curvature of the surface of the lower side 3*b*. FIG. 2 shows the shield 3 in the second stable mechanical state folded in the direction of the nipple 2. The shield 3 surrounds the nipple 2 partly or substantially and thus protects the nipple 2 against contact with other objects, such as dirt. The shield 3 is then in a closed position: the nipple 2 is not accessible for a child to suckle on. In the second state the shape of the shield 3 is concave. The second state is a stable mechanical state as well: when no force is applied to the shield 3, the shield remains in the second state. In the second state the curvature of the surface of the lower side 3*b* of the shield 3 is larger than the radius of curvature of the surface of the upper side 3*a*. The shield 3 thus serves two purposes: one of acting as a shield to prevent the pacifier from being swallowed by the suckling infant and one of being a nipple cover to safely and hygienically protect the nipple 2 against among others dirt, bacteria, other children.

The shield 3 of the pacifier 1 is elastically transformable between the first stable mechanical state and the second stable mechanical state. In the first stable state the shield 3 is dome shaped and the surface of the upper side 3*a* of the shield 3 is on the outer surface of the dome. Since the shield 3 has a finite stiffness, the transition from the first state to the second state or vice versa entails a forceful deformation of the shield 3, so as to press a relatively large shield area through a confined underlying plane, disposed in a plane transverse to the axis of the nipple 2. The deformation of the shield 3 entails temporary displacement of material of shield material towards the central axis of the nipple 2, which results in a compressive stress in the shield 3 wall in the circumferential or tangential direction. Upon passing the confined underlying plane, the stress in the shield will be released and the material in the shield will transit to the second stable state. In the second stable state the shield surrounds the nipple at least partially. The stable states in which the shield 3 is substantially relaxed, represent an elastic-energy minimum that is lower than that of the unstable state, in which the shield 3 is partly deformed.

The transition from the first state to the second state or vice versa entails a similar forceful deformation of the shield 3, so as to press a relatively large shield area through a confined underlying plane, disposed in a plane transverse to the axis of the nipple 2. The deformation of the shield 3 entails temporary displacement of material of shield material towards the central axis of the nipple 2, which results in a compressive stress in the shield 3 in the circumferential or tangential direction. Upon passing the confined underlying plane, the stress in the shield 3 will be released and the material in the shield will transit to the other stable state, i.e. the second stable state upon passing the confined underlying plane from the first stable state and the first stable state upon passing the confined underlying plane from the second stable state. The unstable, intermediate state forms a barrier to freely transfer from the first stable state to the second stable state and vice versa. Accordingly the first and the second stable mechanical states can be characterized as stable equilibria which are separated from each other by the intermediate state.

The shield 3 can transform from the first stable state to the second stable state by a force executed by a user, for example a parent who wants to put aside the pacifier 1 when he wants to feed the child. The shield can also transfer from the first stable state to the second stable state upon impact, for example when the shield 3 of the pacifier 1 hits the floor. In both situations the shield 3 transforms from a substantially dome shaped or substantially flat shield to a shape that substantially covers the nipple 2. The second stable state protects the nipple 2 against the environment. The transfer from the unfolded state to the folded state does not occur until the force or impact exceeds a threshold value. When the force or impact is above the threshold value the shield transfers from the first stable state to the second state or vice versa. The value of the threshold force is the result of among others material and geometry of the shield 3. The threshold values for both transfers do not necessarily be equal. A consideration in the design of threshold value of transfer from the first stable state to the second stable state can be that the shield 3 should not transfer from the first stable state to the second stable state when the child suckles on the nipple and the nipple 2 and part of the shield 3 is pulled in the child's mouth or when the child pushes onto the shield parts 3*c*.

It is advantageous that the shield 3 has a curved geometry. A curved geometry is energetically favourable over shapes that are not curved: the elastic-energy minimum is lower, because the internal stresses are lower. A preferred shape of the second stable state of the shield is spherical. A spherical shape of the shield 3 surrounds the nipple 2 at least partially and direct contact between the nipple 2 and the environment is prevented.

When a force or an impact is executed on the shield 3 in the first stable state, the shield 3 is being deformed locally and internal stresses occur in the deformed part of the shield 3. These internal stresses influence adjacent parts of the shield 3, such that the adjacent parts of the shield 3 deform locally as well. Each local deformation thus triggers adjacent parts to deform and so the shield 3 deforms to the second stable state via the intermediate state.

In the shield 3 one or more cutouts 6 can be made. The cutouts 6 preferably have a primary orientation away from the lower side 2*b* of the nipple. Consequently in the second stable mechanical state the cutouts 6 are oriented from the lower side 2*b* of the nipple 2 to the upper side 2*a* of the nipple 2. The cutouts 6 can be made in any suitable shapes and sizes to provide a safe and comfortable touch upon the child's skin in the first state of the shield 3 and to provide a proper protection for the nipple 2 in the second state of the shield 3. The cutouts 6 reduce the tangential or circumferential stress in the shield 3. Consequently, to transform the shield 3 from the first stable state to the second state or vice versa via the compressive state requires a lower force. In the first stable mechanical state the cutouts 6 can be shaped such that a cutout is present around the nose of the suckling child. A cutout at the location of the nose allows the child to breathe through its nose while sucking on the pacifier. Because the child does not have to open its mouth to breathe, the risk of dropping the pacifier reduces. The presence of cutouts 6 attributes positively to air ventilation between the shield 3 and the child's face. Air ventilation helps prevent skin irritation and/or a suction-cup effect caused when saliva is present between the shield 3 and the child's face when suckling the pacifier 1. In the second stable state the appliance of cutouts 6 helps to establish a spherical nipple cover 3*b* to protect the nipple 2. The presence of cutouts 6 allows the shield parts 3*c* to surround the nipple easier. The shield parts 3*c* thus surround the nipple at least partly, but preferably fully.

It is preferable that the shield 3 is made of an elastomeric material. The preferred elastomeric material may include silicone or latex, one or more thermoplastic elastomers or a combination thereof. The elastic properties of the material allow the shield 3 to transfer from the first state to the second state.

The shield 3 can be made in any suitable size to provide a safe and comfortable touch upon the child's skin in the first state of the shield 3 and to provide a proper protection for the nipple 2 in the second state of the shield 3. The shape of the shield 3 has to be suitable for interaction with the child's face while suckling on a pacifier 1.

The handle 4 may be in any shape, size or design suitable for handling the pacifier 1 when the pacifier 1 is being used, washed or carried. The handle 4 is generally made is a hard plastic material. The handle 4 can be jointly connected to the shield 3, usually at the location of a knob 5, such that it can turn or flip with respect to the shield 3. The handle 4 can be fixed to the shield 3. A fixed handle 4 is usually smaller than a jointly connected handle 4. Usually the jointly connected handle 4 is used for removing the pacifier 1 from the child, while a fixed handle 4 is used for attaching a pacifier 1 attachment band to connect the pacifier 1 to the child's clothes. Although FIGS. 1 and 2 present a pacifier 1 comprising a jointly connected handle 4, it is obvious to the skilled person that the handle 4 is not necessary to achieve the object of the invention.

The invention claimed is:

1. A pacifier comprising:

a nipple; and a shield that comprises a single element made of an elastic material, wherein the nipple is coupled to a first side of the single element, wherein the shield is elastically transferable between two distinct stable mechanical states that comprise a first stable mechanical state and a second stable mechanical state, wherein the shield is operative (i) in the first stable mechanical state that is unfolded in a direction away from the nipple as a protective shield to prevent the pacifier from being swallowed, and (ii) in the second stable mechanical state that is folded in a direction of the nipple as a nipple cover, wherein responsive to an impact to the shield that comprises an instantaneous force, which is greater than a threshold force to be exceeded and different from a continuous force, a tension built up in the elastic material of the shield transfers the shield from the first stable mechanical state to the second stable mechanical state.

2. The pacifier according to claim 1, wherein the shield has a curved geometry.

3. The pacifier according to claim 1, wherein the shield is spherically shaped in both the first stable mechanical state and the second stable mechanical state.

4. The pacifier according to claim 1, wherein the shield further comprises a geometry that determines the tension built up in the elastic material of the shield and a corresponding threshold force executed on the shield that is to be exceeded, for triggering the shield to transfer from the first stable mechanical state to the second stable mechanical state in response to the impact to the shield.

5. The pacifier according to claim 1, wherein the shield further comprises one or more cutouts in the elastic material.

6. The pacifier according to claim 5, further wherein the cutouts have a primary orientation away from a lower side of the nipple.

* * * * *